US007773046B2

(12) United States Patent
Shigemoto

(10) Patent No.: US 7,773,046 B2
(45) Date of Patent: Aug. 10, 2010

(54) ANTENNA DEVICE

(75) Inventor: Hideki Shigemoto, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/878,690

(22) Filed: Jul. 26, 2007

(65) Prior Publication Data

US 2008/0030423 A1 Feb. 7, 2008

(30) Foreign Application Priority Data

Aug. 1, 2006 (JP) ..... 2006-209663

(51) Int. Cl.
*H01Q 1/22* (2006.01)
*H01Q 1/42* (2006.01)

(52) U.S. Cl. ..... 343/872

(58) Field of Classification Search ..... 343/702, 343/872, 906, 895, 873; 439/578, 916
See application file for complete search history.

(56) References Cited

U.S. PATENT DOCUMENTS 3,573,840 A * 4/1971 Gouillou et al. ..... 343/895
3,596,273 A * 7/1971 Francis et al. ..... 343/793
3,781,899 A * 12/1973 Lockwood ..... 343/880
4,435,713 A * 3/1984 Gasparaitis et al. ..... 343/702
4,935,747 A * 6/1990 Yuichi et al. ..... 343/895
6,133,884 A * 10/2000 Talvitie et al. ..... 343/702

FOREIGN PATENT DOCUMENTS

JP 2001-345615 12/2001

* cited by examiner

*Primary Examiner*—Michael C Wimer
(74) *Attorney, Agent, or Firm*—McDermott Will & Emery LLP

(57) ABSTRACT

The present invention provides an antenna device that is easy to manufacture by doing away with the wiring section. The antenna device includes an antenna member housed inside a nearly tubular case and a terminal body electrically connected to the antenna member for taking out electrical signal to outside, and the antenna member is sealed inside the case. The antenna device also has a housing for sealing the antenna member inside the case for engaging with a connector to be coupled, and a plugging member having an O-ring and a terminal stage fit into a nearly integral unit.

6 Claims, 5 Drawing Sheets

ANTENNA DEVICE

BACKGROUND OF THE INVENTION

1. Field of the Invention

The present invention relates to antenna devices for use in remote control devices that communicate with portable devices and remotely control locking/unlocking of vehicle doors and the like.

2. Background Art

Recently, remote control devices for remotely controlling locking/unlocking of vehicle doors based on communication between a vehicle-borne antenna device and a portable device are becoming widely used.

Referring to FIG. 5, description of a conventional antenna device used in such remote control devices will be given.

FIG. 5 is a sectional view of a conventional antenna device. In FIG. 5, nearly box-like case 101 made of a nonconductive material is formed with opening 101A provided on the top face and with lead terminals 102A, 102B integrally formed and embedded on a left side face.

Antenna member 103 consists of core 103A, coil 103B and capacitor 103C. Starting end of coil 103B wound on the outer periphery of core 103A is connected to lead terminal 102A while end of winding of coil 103B is connected to one end of capacitor 103C. The other end of capacitor 103C is connected to lead terminal 102B. Case 101 houses antenna member 103 within itself.

Also, each of lead terminal 102A and lead terminal 102B is connected to lead wire 105 outside of case 101 by pressure bonding, for example. Here, each of the connecting sections of lead terminal 102A, lead terminal 102B and lead wire 105 is covered with heat-shrinkable tube 109 to prevent from being exposed to outside.

Furthermore, a connector (not shown) provided behind lead wire 105 and a connector to be coupled of a vehicle-borne device (not shown) are trunk connected. Here, for the convenience of description, the right side of FIG. 5, namely the side of antenna member 103, is referred to as main body section 110A and the left side, namely the side of lead wire 105, is referred to as wiring section 110B.

Also, filler 106 such as silicone resin or epoxy resin is filled to seal in antenna member 103 inside case 101. Filler 106 is subsequently hardened at a predetermined temperature and antenna member 103 is secured inside case 101.

Subsequently, locking holes 104A provided on the sides of lid 104 having an opening on its lower face are engaged with nails 101B of case 101, thus covering opening 101A of case 101 with lid 104 and completing antenna device 110.

In the above configuration, main body 110A of antenna device 110 is disposed inside a door handle of a vehicle door. Wiring section 110B pulled out from within the door handle is wired inside a space formed between exterior chassis of the vehicle door and interior rubber of the vehicle door. At the same time, posterior portion of wiring section 110B is connected with the vehicle-borne device by transmit connection.

Radio signal communication is conducted between a portable device (not shown) carried by a user and the antenna device 110, and the vehicle-borne device identifies the signal received from antenna device 110 and remotely operates locking and unlocking of vehicle doors.

As conventional art information relating to the invention of this patent application, Japanese Unexamined Patent Application Publication No. 2001-345615, for example, is known.

However, with such conventional antenna device 110 as described above, it is necessary to adjust the length of lead wire 105 of wiring section 110B in accordance with the type of vehicle or the position of disposing antenna device 110. Accordingly, the conventional device has problems of requiring many components, complication in manufacturing, and increase in the types of antenna device 110.

SUMMARY OF THE INVENTION

An antenna device comprising a tubular case having an opening on one side face, an antenna member housed inside the case, a terminal body electrically connected with the antenna member and outwardly extending, and a plugging member having the terminal body and sealing the antenna member inside the case and closing the opening of the case, wherein the plugging member is integrally provided with a housing which is engaged with a connector to be coupled.

DETAILED DESCRIPTION OF PREFERRED EMBODIMENTS

The present invention provides an antenna device that solves conventional problems as described above, does away with the wiring section, and is easy to manufacture.

Referring now to FIG. 1 to FIG. 4D, description will be given in the following on preferred embodiments of the present invention.

Figure 1:
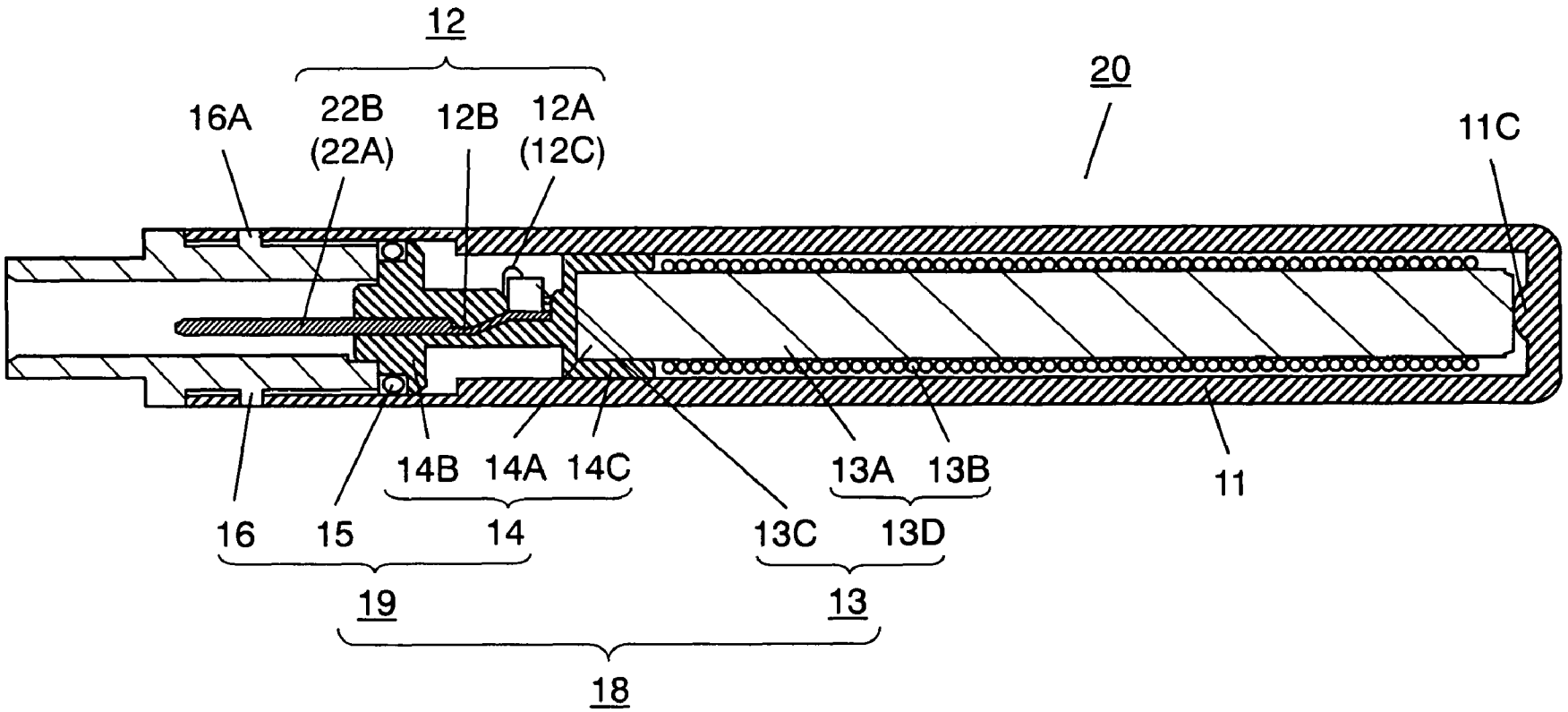
FIG. 1 is a sectional view of an antenna device in a preferred embodiment of the present invention.
Figure 2A:
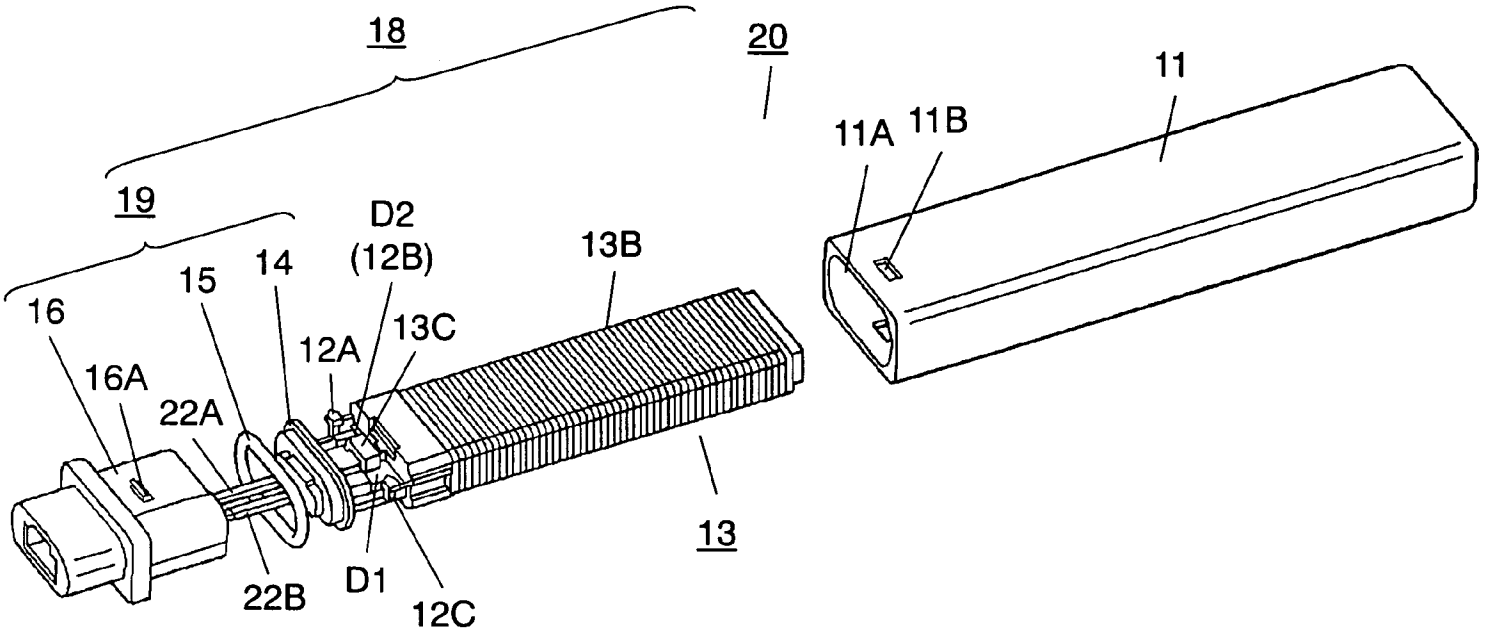
FIG. 2A is an exploded perspective view of an antenna device in a preferred embodiment of the present invention.
Figure 2B:
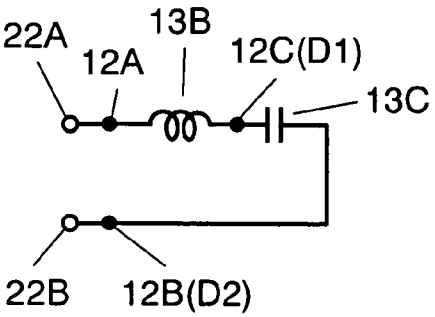
FIG. 2B is an equivalent circuit representation of an antenna device in a preferred embodiment of the present invention.

FIG. 1 is a sectional view of an antenna device in a preferred embodiment of the present invention. FIG. 2A is an exploded perspective view of the antenna device. FIG. 2B is an equivalent circuit diagram of the antenna device. In these figures, nearly tubular case 11 is made of a heat-resistant and mechanically strong material such as polybutylene terephthalate (PBT). Opening 11A is provided on the left side face of case 11.

Antenna member 13 is mainly formed with rod-like core 13A made of a magnetic material such as ferrite, coil 13B wound on its outer periphery, and capacitor 13C connected in series with coil 13B.

Furthermore, core section 13D, being an integrated unit of core 13A and coil 13B, is press fit into opening 14A provided on terminal stage 14. Terminal stage 14 has terminal body 12 insert molded on its one end and is made of resin such as liquid crystal polymer having excellent heat resistance.

This press fitting is performed in a manner such that, when inserting core section 13D, stripes of protrusions (not shown) provided on the inner wall of opening 14A and the outer wall 14C of terminal stage 14 in the direction toward the opening are crushed.

As shown in FIG. 2A and FIG. 2B, starting part of coil 13B and ending part of coil 13B are connected to internal terminal 12A and internal terminal 12C of terminal body 12, respectively, by soldering and the like. One end of capacitor 13C is connected by soldering and the like to electrode D1 formed by extending internal terminal 12C, and the other end of capacitor 13C is connected by soldering and the like to electrode D2 formed by extending internal terminal 12B. As shown by the equivalent circuit of FIG. 2B, these sections form a circuit in which coil 13B and capacitor 13C are connected in series.

In addition, each of internal terminal 12A and internal terminal 12B is extended to make lead terminal 22A and lead terminal 22B for taking out electrical signal from antenna member 13, respectively. Terminal body 12 is formed by providing these elements into an integrated unit.

Also, as shown in FIG. 1, step-like guard 14B is provided outwardly of terminal stage 14. O-ring 15 is disposed on the step portion, and nail 16A of external housing 16 is locked to locking hole 11B of case 11. O-ring 15 is sandwiched between housing 16 and terminal stage 14.

Meanwhile, as the material for housing 16, heat resistant and mechanically strong material such as PBT used for case 11 is preferable. As the material for O-ring 15, resin material having good elasticity such as elastomer, urethane or silicone rubber is preferable.

Plugging member 19 is formed by fitting together housing 16, O-ring 15 and terminal stage 14 into a nearly integrated unit.

And, member-to-be-housed 18, being an integrated unit of plugging member 19 and antenna member 13, is housed into case 11 through opening 11A. During this process, core 13A on the tip of member-to-be-housed 18 hits bottom face 11C of case 11. By inserting plugging member 19 with the surface or point of contact as the point of support and locking, plugging member 19 closes opening 11A of case 11.

Accordingly, antenna device 20 is so configured that O-ring 15 is compressed and prevents water immersion into case 11 from outside.

Figure 3:
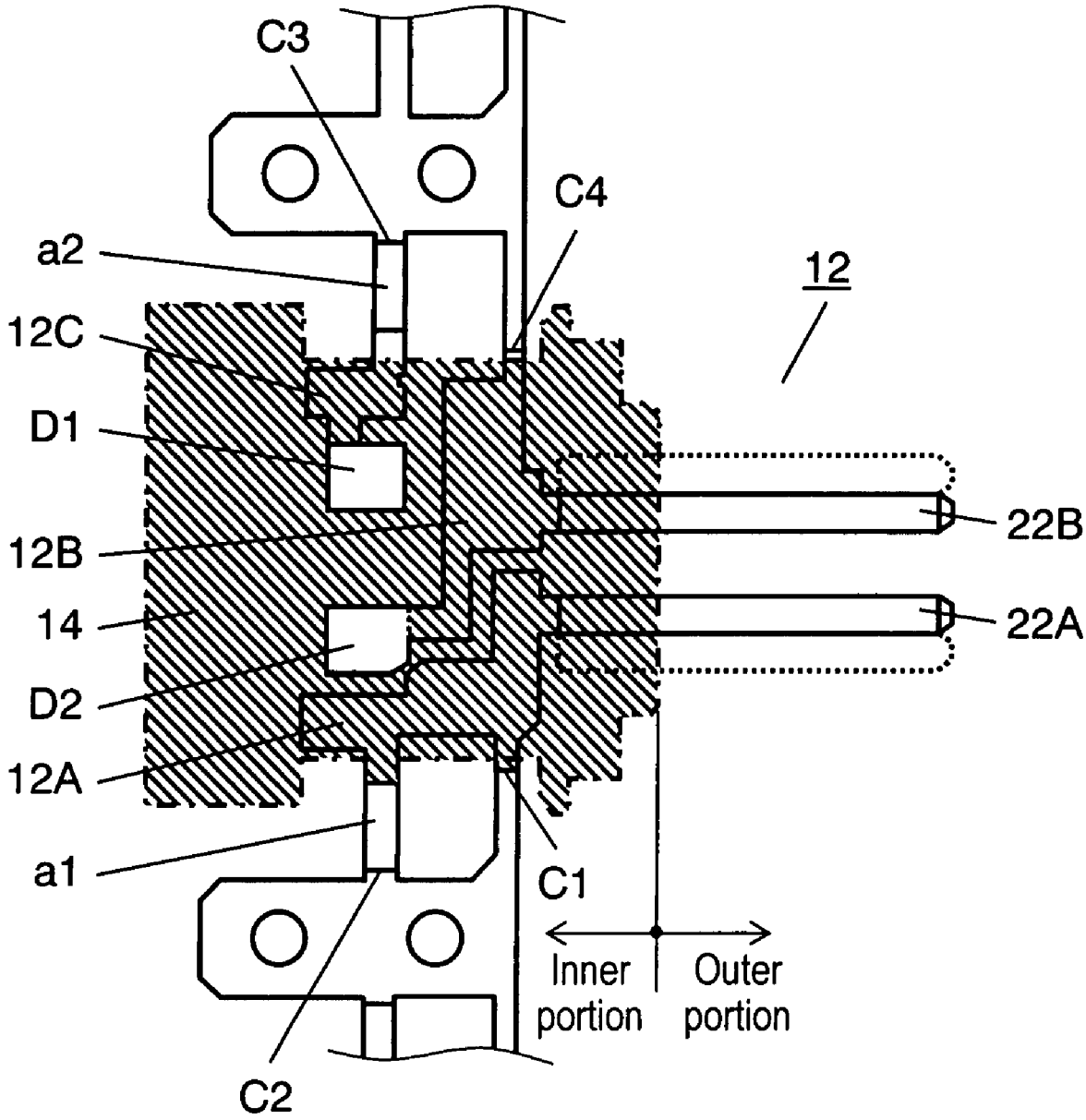
FIG. 3 is an enlarged plan view of a key part of an antenna device in a preferred embodiment of the present invention.

Next, detailed description of terminal body 12 will now be given referring to FIG. 3.

First, terminal body 12 is formed by integrally providing internal terminals 12A, 12B, 12C and lead terminals 22A, 22B. Terminal body 12 is formed into a predetermined configuration by pressing or etching hoop material of about 0.3 mm-thick thin metal sheet, for example.

Also, lead terminal 22A and lead terminal 22B are formed by doubling up the above-mentioned thin metal sheet to secure a predetermined thickness of about 0.6 mm, for example. Lead terminal 22A and lead terminal 22B are connected with respective connectors to be coupled.

Furthermore, after terminal body 12 is formed integrally with terminal stage 14, it is cut off at cutting sections C1 to C4 shown in FIG. 4 and separated from the hoop material, and, at the same time, each of bending sections a1, a2 of internal terminals 12A, 12C is bent. Also, electrodes D1, D2 are integrally formed by extending internal terminals 12C, 12B, respectively.

Figure 4A:
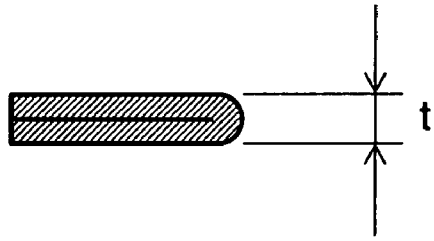
FIG. 4A is an enlarged sectional view of a key part of an antenna device in a preferred embodiment of the present invention.
Figure 4B:
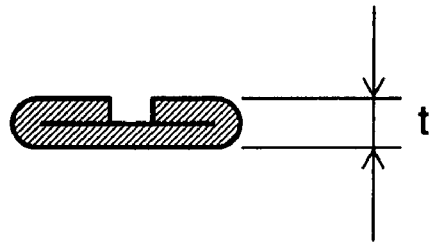
FIG. 4B is an enlarged sectional view of a key part of an antenna device in a preferred embodiment of the present invention.
Figure 4C:
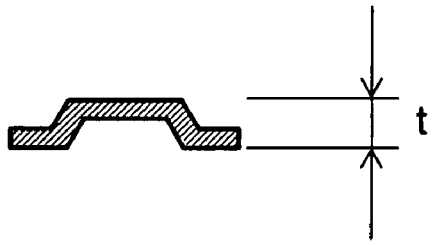
FIG. 4C is an enlarged sectional view of a key part of an antenna device in a preferred embodiment of the present invention.

Here, plugs 22A, 22B to be connected with respective connectors to be coupled are formed such that a predetermined thickness "t" is secured by doubling up a thin metal sheet as shown in FIG. 4A. However, as shown in FIG. 4B, plugs 22A, 22B may be formed by doubling up each side of a thin metal sheet at a position approximately a quarter of the width from the edge to obtain a predetermined thickness "t."

Figure 4D:
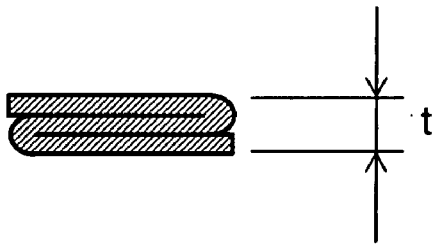
FIG. 4D is an enlarged sectional view of a key part of an antenna device in a preferred embodiment of the present invention.
Figure 5:
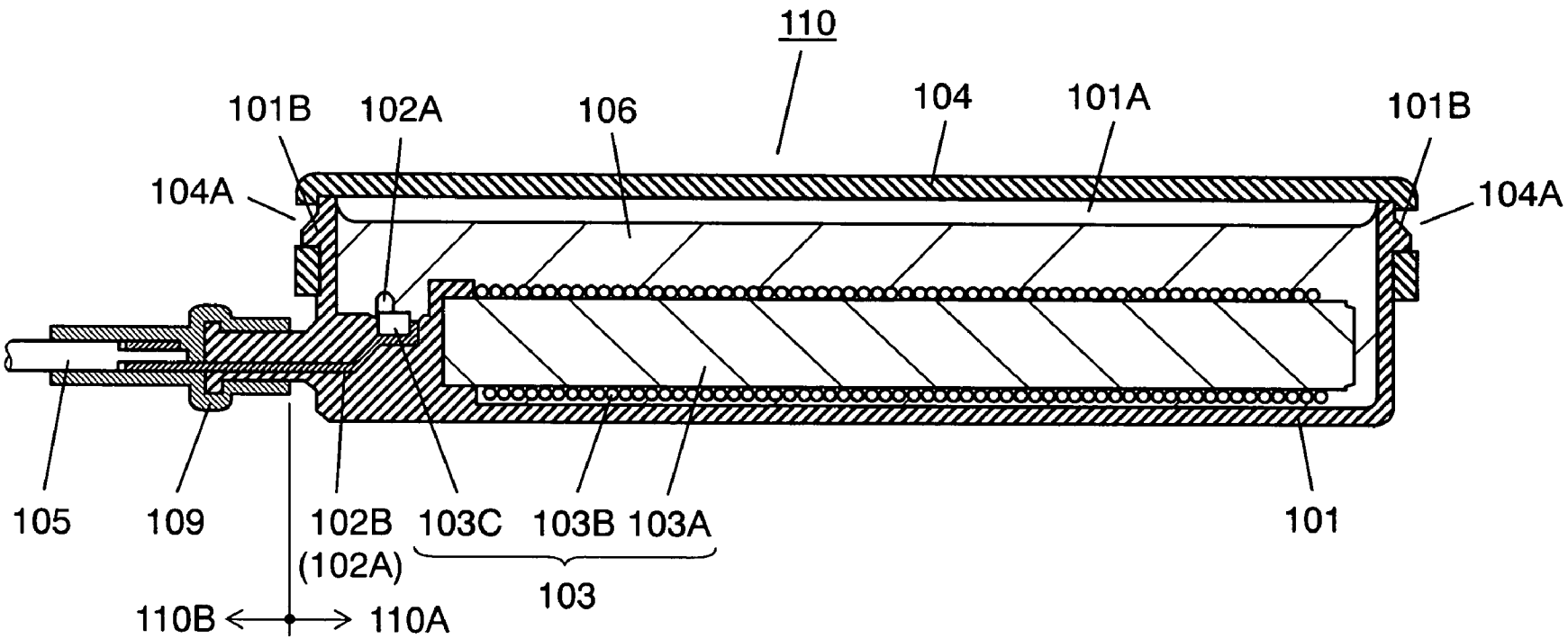
FIG. 5 is a sectional view of a conventional antenna device.

Plugs 22A, 22B may also be formed by using a thinner metal sheet with a thickness of about 0.2 mm, for example, and folding it in three to obtain the predetermined thickness "t" as shown in FIG. 4D.

By doing like this, thickness "t" required for connection with connectors to be coupled can be secured for plugs 22A, 22B even when a thin metal sheet is employed. At the same time, reliability of connection can be enhanced by being able to provide resilience in the direction of thickness when connecting with connectors to be coupled.

In addition, as internal terminals 12A, 12B, 12C of terminal body 12 and electrodes D1, D2 can be formed with the thickness of thin metal sheets, heat capacity required for soldering can be decreased when connecting coil 13B and capacitor 13C to internal terminals 12A, 12B, 12C and electrodes D1, D2.

Furthermore, lighter weight can be achieved as internal terminals and electrodes of terminal body 12 can be formed with a thinner material and, at the same time, processing becomes simpler.

In the above configuration, antenna device 20 is disposed inside a door handle of a vehicle door, and a connector to be coupled with a vehicle-borne device (not shown) is connected with housing 16.

Antenna device 20 communicates by radio signals with a portable device (not shown) carried by a user, and the vehicle-borne device decodes the signal received from antenna device 20 and remotely controls locking/unlocking of vehicle doors.

In this way, according to this preferred embodiment, plugging member 19 for blocking up opening 11A of case 11 has an integrally provided housing 16 with which connector to be coupled will fit, thus doing away with conventionally required wiring section 110B. At the same time, a single type of antenna device is obtainable that can cope with different vehicle types or different locations of the antenna device.

Also, terminal body 12 is integrally provided with plugs 22A, 22B to be connected with connectors to be coupled, and internal terminals and electrodes for electrical connection with antenna member 13. As a result, the component count can be reduced when compared with a model requiring separate units.

The antenna device in accordance with the present invention has advantages of doing away with a conventionally required wiring section and being easy of manufacturing, and is useful as an antenna device to be used for a remote control device for remote control of locking/unlocking of vehicle doors.

What is claimed is:

1. An antenna device comprising:

a tubular case having an opening on one side face;

an antenna member housed inside the case;

a terminal body electrically connected with the antenna member and outwardly extending; and a plugging member having the terminal body and sealing the antenna member inside the case and closing the opening of the case, wherein the plugging member is integrally provided with a housing which is engaged with a connector to be coupled, and said plugging member is non-movable relative to said tubular case, and the plugging member includes an O-ring which seals the inside of the case.

2. The antenna device of claim 1, wherein the terminal body is integrally provided with a plug formed by processing a thin metal sheet to a predetermined configuration, and to be connected with the connector to be coupled, and an electrode to be electrically coupled with the antenna member.

3. The antenna device of claim 2, wherein the plug of the terminal body is formed by folding a thin metal sheet to a predetermined thickness.

4. The antenna device of claim 1, wherein said plugging member further includes a locking mechanism for securing said tubular case to said plugging member.

5. The antenna device of claim 1, wherein the plugging member closes the opening of the case to prevent water from entering into the case.

6. The antenna device of claim 1, wherein the O-ring seals the inside of the case to prevent water from entering into the case.

* * * * *